US012416405B2

(12) United States Patent
Farrer

(10) Patent No.: US 12,416,405 B2
(45) Date of Patent: Sep. 16, 2025

(54) PRESSURE REGULATION AND OPERATIONAL CONTROL FOR FLAME DISPLAY CONFIGURATION

(71) Applicant: Red Weather Systems Inc., Costa Mesa, CA (US)

(72) Inventor: Trent Farrer, Vancouver, WA (US)

(73) Assignee: RED WEATHER SYSTEMS INC., Costa Mesa, CA (US)

( * ) Notice: Subject to any disclaimer, the term of this patent is extended or adjusted under 35 U.S.C. 154(b) by 540 days.

(21) Appl. No.: 17/815,511

(22) Filed: Jul. 27, 2022

(65) Prior Publication Data

US 2024/0035657 A1 Feb. 1, 2024

(51) Int. Cl.
*F23N 1/00* (2006.01)
*F23K 5/00* (2006.01)

(52) U.S. Cl.
CPC ..... *F23N 1/007* (2013.01); *F23K 5/005* (2013.01); *F23K 2203/105* (2013.01); *F23N 2235/12* (2020.01)

(58) Field of Classification Search
CPC ..... F23N 1/007; F23N 2235/12; F23K 5/005; F23K 2203/105
USPC ..... 431/12
See application file for complete search history.

(56) References Cited

U.S. PATENT DOCUMENTS 5,890,485 A * 4/1999 Shimek ..... F23N 5/203 126/92 R
2003/0201336 A1* 10/2003 Rumens ..... F21S 8/00 239/17
2015/0241068 A1* 8/2015 Deng ..... F24C 3/002 431/285

* cited by examiner

*Primary Examiner* — Avinash A Savani
(74) *Attorney, Agent, or Firm* — McCoy Russell LLP

(57) ABSTRACT

Methods and systems for a fire device, comprising a common fuel line coupled to a fuel source via a first pressure regulator, wherein the first pressure regulator is configured to provide gaseous fuel from the fuel source to the common fuel line at a first pressure. A first fire display device is coupled to the common fuel line via a second pressure regulator, wherein the second pressure regulator is positioned downstream of the first pressure regulator and provides the gaseous fuel to the first fire display device at a second pressure that is lower than the first pressure.

17 Claims, 8 Drawing Sheets

PRESSURE REGULATION AND OPERATIONAL CONTROL FOR FLAME DISPLAY CONFIGURATION

FIELD

The present description relates generally to methods and systems for controlling a fire display.

BACKGROUND/SUMMARY

A fire pit is a vessel for containing a flame, typically used outdoors, and may be considered a type of fire display device. A torch may also be considered a type of fire display device. In some cases, it may be desirable to equip a space with multiple fire display devices including multiple fire pits and/or torches. However, pressure regulation may be challenging, and it is additionally inconvenient to procure separate fuel sources for each fire display device. Further, it may be desirable to coordinate the fire display devices to a common input, such as an audio input. Coordinating fire display devices may be result in an entertaining and/or theatrical effect. For example, it may be desired to coordinate fire bursts of the fire display devices to an audio input and with each other without a lag time.

In one example, the issues described above may be addressed by a fire display system comprising a fuel source, a common fuel line coupled to the fuel source via a first pressure regulator, and a first fire display device fluidically coupled to the common fuel line via a second pressure regulator. The first pressure regulator provides the gaseous fuel to the common fuel line at a first pressure, and the second pressure regulator arranged downstream of the first pressure regulator provides the gaseous fuel to the first fire display device at a second pressure that is lower than the first pressure. Further fire display devices may additionally be coupled to the common fuel line in a similar manner as the first fire display device.

In this way, pressure regulation is achieved for improved fire display device operation. Further, multiple fire display devices may share a single fuel source and a single audio input communicated without lag. Further, the number of fire display devices may be increased or decreased without the need for additional tools and minimizing a risk of release of fuel gas to the atmosphere. Additionally, the entertainment and theatrical effect of multiple fire display devices may be increased by coordinated response to an audio input and by positioning of a pilot light at a central focus point of fuel in a burner.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 2A:
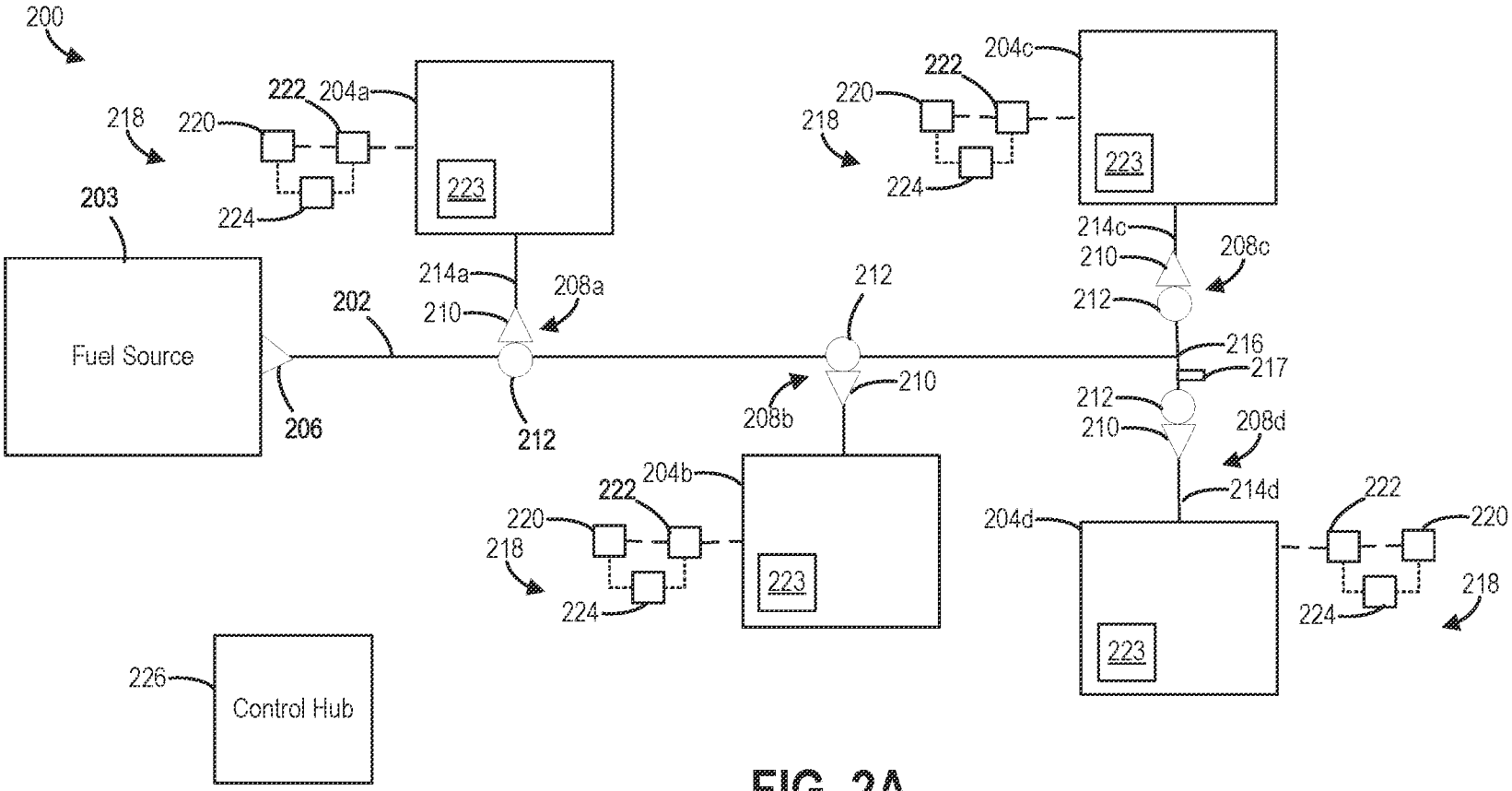
FIG. 2A schematically shows a fire pit system including connections to fire display devices.
Figure 3A:
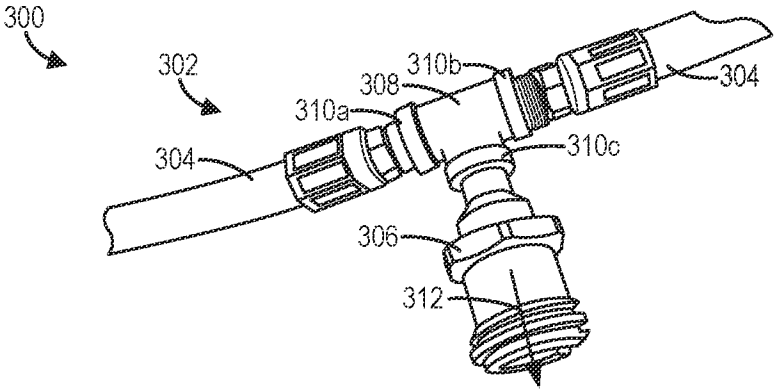
FIG. 3A shows a fuel line and check valve of a fire pit system.
Figure 3B:
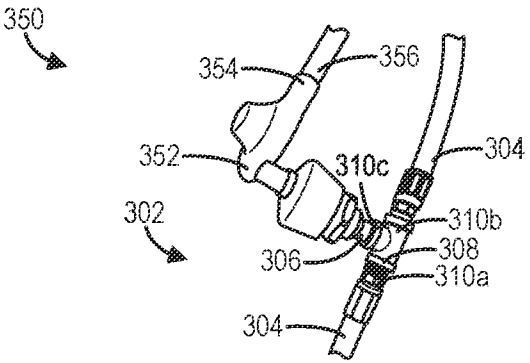
FIG. 3B shows a fuel line, check valve, and pressure regulator of a fire pit system.
Figure 4:
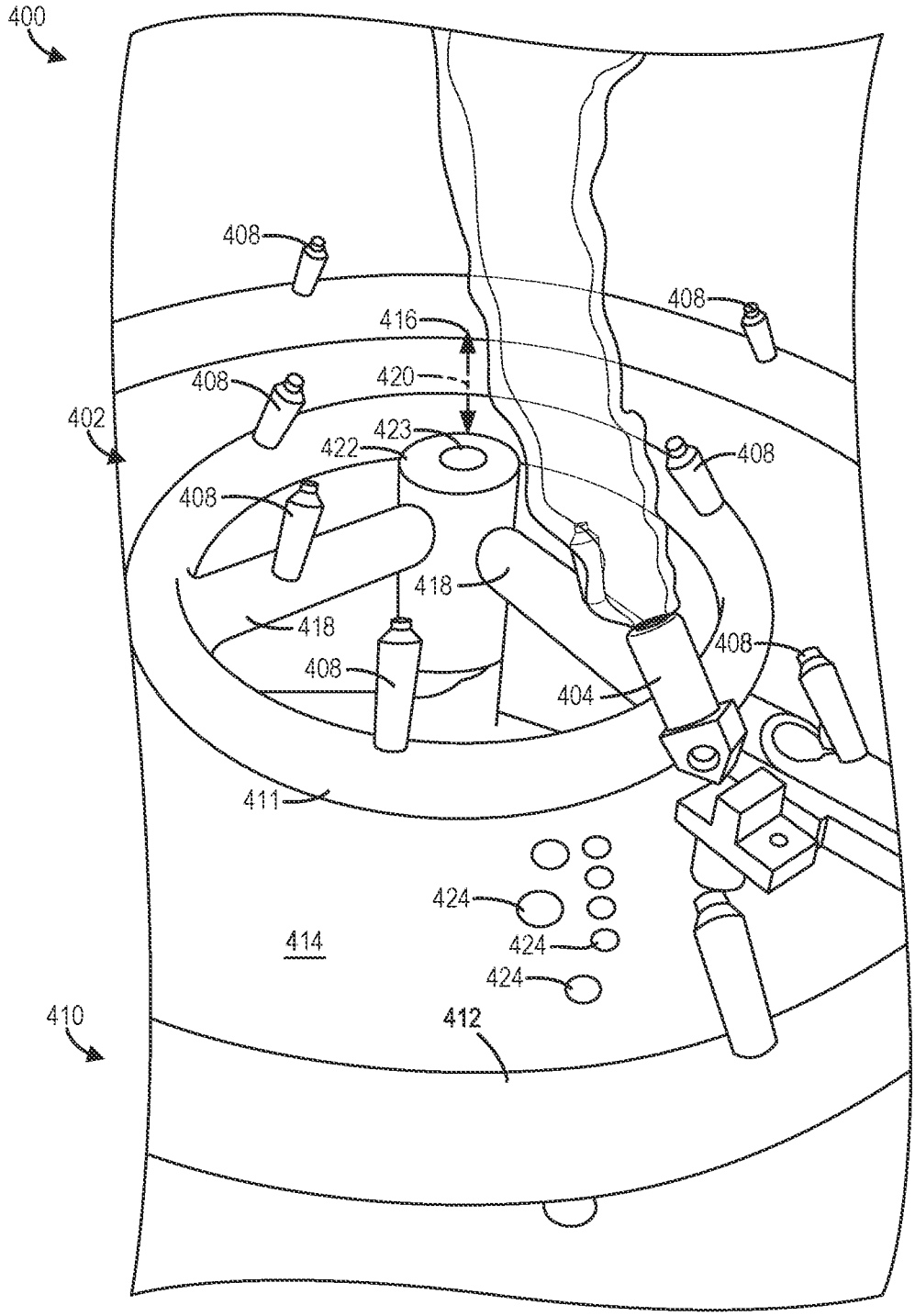
FIG. 4 shows a burner configuration for a fire pit of a fire pit system.

The following description relates to systems and methods for a fire display system which may include multiple fire display devices. A fire display system including multiple fire display devices arranged in a display is shown in an example environment in FIG. 1. Multiple fire display devices may share a single fuel source via a common fuel line as shown in the schematic of FIG. 2A. The fire display devices may receive and distribute the fuel via the ignition system shown in FIG. 2B. The multiple fire display devices may be joined to the common fuel line via check valves and pressure regulators as detailed in FIGS. 3A-3B. The fuel may be ignited at the burner of a fire pit at a burner head including a focusing feed and pilot lite as shown in FIG. 4. The individual fire display devices of the fire display may include user input panels such as the one shown in FIG. 5. Further, the fire display may be controlled by the user input panels and/or a control hub according to the method shown in FIG. 6A-B.

For purposes of discussion, the below figures are described collectively. Thus, similar elements may be labeled similarly and may not be re-introduced. FIGS. 3A-3B and 4-5 are shown approximately to scale, although other relative dimensions may be used, if desired.

Figure 1:
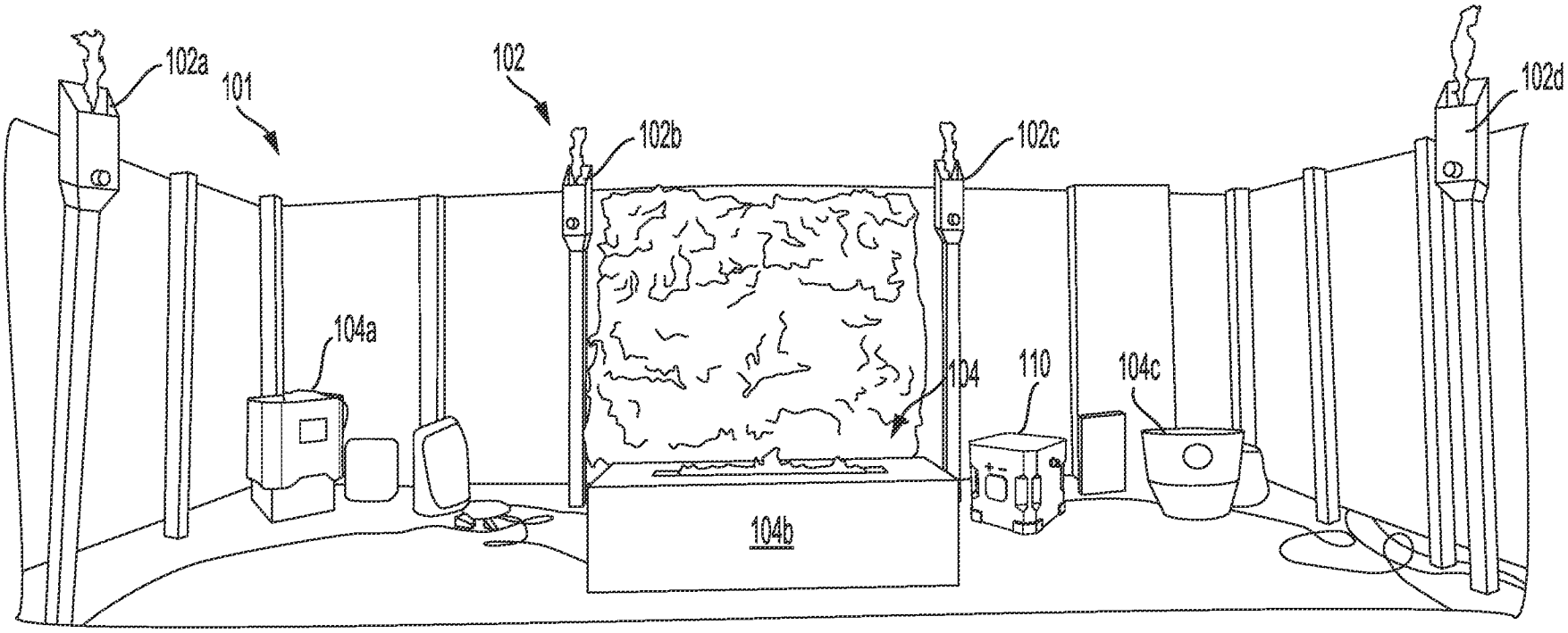
FIG. 1 shows a fire pit system in an environment, according to the present disclosure.

Turning first to FIG. 1, a fire display system 101 is shown in an example environment 100. In the example shown by FIG. 1, the environment 100 is a large warehouse space. In other examples, however, the system environment 100 may instead be an outdoor environment, such as a backyard. The system environment 100 includes fire display devices; herein a fire display device may be a device configured to receive gaseous fuel and generate and contain an open flame. For example, fire display devices may include a plurality of torches 102*a*, 102*b*, 102*c*, 102*d* (also referred to collectively as torches 102). Although there are four torches shown in the example at FIG. 1, it is noted that additional torches or fewer torches may be included in the system without departing from the scope of the disclosure.

In addition to the torches 102, the system environment 100 includes additional fire devices including a first fire pit 104*a*, a second fire pit 104*b*, and a third fire pit 104*c* (also referred to collectively as fire pits 104). As with the torches 102, there may be additional fire pits or fewer fire pits included in the system, in at least one example. The torches 102 and the fire pits 104 together may form a fire display system 101. Each fire pit 104 and torch 102 may include a respective fire device controller, wireless receiver, input panel, and a battery, similar to the examples discussed further below with respect to FIG. 2A. The fire device controllers and/or wireless receivers may receive signals from a hub 110.

The hub 110 is an electronic controller that includes a processor with instructions stored in non-transitory memory that, when executed, cause the hub 110 to send control signals to control one or more of the torches 102 and the fire pits 104. For example, the control signals sent from the hub 110 may be received at fire device controllers and wireless receivers of the respective torches 102 and fire pits 104. Each of the torches 102 and fire pits 104 additionally includes an ignitor and at least one valve positioned therein that is configured to adjust an amount of fuel provided for ignition of the respective torch or fire pit responsive to signals (e.g., electronic signals) transmitted to the respective fire device controller by the hub 110. For example, responsive to a given fire device controller receiving control signals from the hub 110, the fire device controller may command the torches 102 and fire pits 104 to actuate at least one of the electric valve and the ignitor of the respective torch 102 and fire pit 104. Via such actuation, a flame size and height may be controlled for the torches 102 and fire pits 104.

The control signals are sent from the hub 110 to one or more of the torches 102 (e.g., to the respective electronic controllers of the one or more torches 102) in response to the processor of the hub 110 receiving input signals. The control signals may further be sent from the hub 110 to one or more of the fire pits 104 (e.g., to the respective electronic controllers of the one or more fire pits 104) responsive to such input signals. In at least one example, the processor of the hub 110 receives input signals via one or more of a wireless receiver of the hub 110, a hardwired connection of the hub 110, and a user interface integrated into the hub 110 itself, where the user interface includes one or more user input devices (e.g., buttons, dials, a touch screen) to receive the input signal.

In at least one example, the hub 110 may be a mobile device of a user, such as a cellular telephone or a laptop of the user. In such examples, it is noted that an application of the mobile device may be used to control the torches 102 and fire pits 104. That is, when the hub 110 is a mobile device, an application of the mobile device may provide a display via the mobile device and receive input signals via a user interface of the mobile device (e.g., buttons, a touch screen).

The input signals received at the hub 110 may include a mode selection made by a user of the fire display system and received at the hub 110. Additionally or alternatively, a mode selection may be received at the input panels of the respective torches 102 and fire pits 104. For example, the mode selection may include selection of a traditional mode or an audio mode. In the traditional mode, the torches 102 and fire pits 104 are operated with their respective electric valves maintained at a predetermined base position. At the predetermined base position, the electric valves of the torches 102 and the fire pits 104 are at least partially open and allow fuel to flow to their respective burners. If the electric valve of any of the torches 102 and fire pits 104 being controlled in the traditional mode is not at the base position when the traditional mode is selected, then the electric valve is first adjusted to the predetermined base position and maintained in the base position for a duration of the traditional mode. Due to the maintained position of the electric valve, a steady flame size and height is maintained in the traditional mode.

In the audio mode, the torches 102 and fire pits 104 are operated with their respective electric valves being varied in coordination to an audio input, such as music. Thus, responsive to receiving a user input selecting the audio torch mode and further receiving the audio input, the hub 110 may send control signals to the audio input devices of torches 102 and fire pits 104 based on the audio input.

In particular, the hub 110 may send control signals to adjust respective electric valves of the torches 102 and the fire pits 104 in coordination with the audio input. It is noted that the audio input may be received at each fire display device. For example, the audio input may be received at the hub 110 via wirelessly streaming the audio input to the hub 110 via a mobile device or other personal computing device. In such examples, a wireless receiver of the hub 110 may receive the audio input. In examples where hub 110 is an application executed at a mobile device, the audio input may be stored at and/or wireless streamed by the mobile device and accessed by the application. As another example, the audio input may be received at the hub 110 via an aux input or other wired audio input. In such examples, a mobile device or other personal computing device may provide the audio input to the hub 110 via such an aux input or other wired audio input.

The electric valve may be adjusted to positions more open than the base position of the traditional mode while in the audio mode, based on the audio input. Additionally, the electric valve may be adjusted to positions that are less open than the base position of the traditional mode while in the audio mode, based on the audio input. In this way, flame bursts and decreases in flame size may be created for the fire display. Thus, in contrast to the traditional mode, the torches 102 and fire pits 104 produce flame sizes and heights that are varied throughout the audio mode in coordination with the audio input.

In at least one example, a flame boost mode may further be available for torches 102 and/or fire pits 104, in which a maximum fuel flow is provided to a burner. In some examples, the flame boost mode may be used for purposes of heating an accessory, such as a griddle or grill attachment. The flame boost mode may also be used for purposes of producing a maximum flame height and size, which may be of interest for lighting or theatrical effect, for example. In the flame boost mode, the respective electric valve of the torches 102 or fire pits 104 is actuated to a wide open position. In at least one example, adjusting the torches 102 or fire pits 104 to operate in the flame boost mode may include adjusting a mechanical valve providing fuel to the burner to a wide open position (e.g., fully opened position), in addition to the electric valve being adjusted to the wide open position.

In examples where the flame boost mode is available, it is noted that the wide open position of the electric valve is more open than the base position for the traditional mode. That is, in examples where the fire devices include the flame boost mode, the flame boost mode creates a maximum flame height and size, which is larger than the flame height and size when operating in the traditional mode.

In at least one example, hub 110 allows for there to be separate control of the torches 102 and the fire pits 104. In separate control examples, it is noted that the mode selections for each of the fire pits 104 and the torches 102 may be made individually set. Thus, each of the torches 102 and each of the fire pits 104 is able to have its own mode selected and individually controlled via the hub 110 and/or via the user input panel at each of the torches 102 and fire pits 104. In at least on example, it is noted that a mode selected at the input panel may take priority to a mode selected at the hub. For example, if the hub 110 receives a request to operate the torches 102 and fire pits 104 in an audio mode but the user input panel of one of the fire pits 104 is set to the traditional mode, then the fire pit set to the traditional mode will be operated in the traditional mode even though the hub 110 is outputting an audio mode control signal. This allows for local control at the input panel of the torches 102 and the fire pits 104 to take priority for a particular torch or fire pit.

Additionally, or alternatively, the hub 110 may control the torches 102 and the fire pits 104 collectively. In collective control examples, the hub 110 may control the torches 102 and the fire pits 104 all together to be in the same mode. For example, in collective control examples, selection of the traditional mode may result in all of the torches 102 and the fire pits 104 being set to the traditional mode. Further, in the collective control examples, selection of the audio mode may result in all of the torches 102 and the fire pits 104 being set to the audio mode. As to selection of the flame boost mode, in the collective control examples, selection of the flame boost mode may result in all of the torches 102 and the fire pits 104 being controlled to have their respective electric valves in a wide open position.

Further, the hub 110 may additionally or alternatively control the torches 102 and fire pits 104 in sub-groups. In such sub-group control, sub-groups of the torches 102 and/or the fire pits 104 may be formed for control of the sub-group to be the same. For example, in sub-group control, the hub 110 may control the torches 102 together as an all torches sub-group and may control the fire pits 104 together as an all fire pits sub-group. Thus, in this example, the mode for the all torches sub-group being selected as the traditional mode would result in the torches 102 all being set to the traditional mode. Alternatively, the mode for the all torches sub-group being selected as the audio mode would result in the torches 102 all being set to the audio mode. Similarly, in this example, the mode for the all fire pits sub-group being selected as the traditional mode would result in the fire pits 104 all being set to the traditional mode. Or, alternatively, the mode for the all fire pits sub-group being selected as the audio mode would result in the fire pits 104 all being set to the audio mode.

In another sub-group control example, the hub 110 may control a portion of the torches 102 as a first torch sub-group, another portion of the torches 102 as second torch sub-group, a portion of the fire pits 104 as a first fire pit sub-group, and another portion of the fire pits 104 as a second fire pit sub-group. Moreover, a sub-group may contain both torches 102 and fire pits 104, in at least one example.

It is noted that if selection of any of the traditional mode, audio mode, and flame boost mode is also determined to initiate ignition at one or more of the torches 102 and fire pits 104, then the hub 110 may further send a control signal to activate respective ignitors of such torches and fire pits.

As described above, a fire display including multiple fire display devices may require multiple fuel containers, one for each fire display device. Further, the multiple fire display devices may not be coordinated devices able to create a desired effect, especially when the intensity of flame at each fire display device may be controlled individually or as a group or sub-group. A plurality of fire display device including respective controllers and wireless receivers as shown in FIG. 2A below may allow a coordinated display between multiple display devices and a common fuel line may allow multiple devices to be fueled by a single fuel container.

Turning now to FIG. 2A, a fire display system 200 is schematically shown. The fire display system 200 includes a common fuel line 202 and a fuel source 203. The fire display system 200 may be similar to, or the same as, the fire display system 101 described above with reference to FIG. 1. Fuel source 203 may be a rigid container holding a gaseous fuel at pressures above room pressure. The gaseous fuel may be liquefied petroleum gas (LPG), also referred to as propane. In other examples, the gaseous fuel may be natural gas. Fuel source 203 may hold the gaseous fuel at a high pressure above room pressure. For example, the pressure of the gaseous fuel inside fuel source 203 may be between 100 psi and 200 psi. A first pressure regulator 206 may be coupled to fuel source 203 to release the gaseous fuel from fuel source 203 at a pressure lower than the storage pressure. For example, first pressure regulator 206 may be configured to release gaseous fuel from fuel source 203 between 20 psi and 50 psi, though other pressure ranges are possible without departing from the scope of the disclosure. In one example, first pressure regulator 206 may release gaseous fuel at 30 psi.

Fuel source 203 may be fluidically coupled to a first fire display device 204*a*, a second fire display device 204*b*, a third fire display device 204*c*, and a fourth fire display device 204*d* (also referred to as fire display devices 204) via common fuel line 202 coupled to first pressure regulator 206. In some embodiments, the number of fire display devices may be between one and five. Common fuel line 202 may a flexible hose formed from a non-porous material chemically compatible with gaseous fuel. For example, common fuel line 202 may be formed from nitrile rubber or other flexible materials. For example, the common fuel line 202 may be a corrugated hose. In at least one example, when laid straight, common fuel line 202 may cover a length of up to 50 feet. In other examples, the common fuel line 202 may extend a length greater than 50 feet when laid straight. In some examples, common fuel line may include one or more junction 216 such that common fuel line 202 extends in two different directions. For example, junction 216 may be a T-junction or a Y-junction.

Common fuel line 202 may also include a bleed valve 217. Bleed valve 217 may be positioned on common fuel line 202 at a point substantially furthest away from fuel source 203. For example, bleed valve 217 may be positioned between junction 216 and pressure junction 208*d*. Bleed valve 217 may be opened to allow air trapped in common fuel line 202 to be vented while common fuel line 202 is filled with gaseous fuel.

Fire display devices 204 may include fire pits and/or torches to collectively form a fire display as described above with respect to FIG. 1. Fire display devices 204*a-d* may be fluidically coupled to common fuel line 202 via pressure junctions 208*a*, 208*b*, 20*k*8*c*, and 208*d* (also referred to as pressure junctions 208) and individual fuel lines 214*a*, 214*b*, 214*c*, and 214*d* respectively (also referred to as individual fuel lines 214). Individual fuel lines 214 may be formed of the same material as common fuel line 202 and may be between 2 feet and 20 feet and fluidically couple pressure junctions 208 to the respective fire display devices 204, though it is noted that other ranges for length are possible. Individual fuel lines 214 may be coupled at a first end to fire display devices 204 via a quick connect. A quick connect may be a coupler configured to fluidically join two components without the use of a tool such as a wrench. A quick connect may automatically seal upon decoupling, containing fluid within the vessel or line to which it is attached. Individual fuel lines 214 may be coupled to pressure junctions 208 at a second end. In some embodiments, the pressure junction may couple directly to fire display devices 204 via a quick connect without individual fuel lines 214. In this way, fire display devices 204 may be coupled and decoupled from common fuel line 202 without the use of tools and minimizing an amount of gaseous fuel released to atmosphere.

Pressure junctions 208 may include a check valve 212, where the check valve 212 is coupled at a first end to common fuel line 202 and where the check valve 212 is coupled at a second end opposite the first end to a second pressure regulator 210. Check valve 212 may be configured to ensure gaseous fuel flows only from common fuel line 202 to fire display devices 204 and not in the opposite direction. Second pressure regulator 210 may be configured to deliver gaseous fuel to the fire display device between 0.5 psi and 5 psi. The psi may be selected based on the fuel requirements of the fire display device to which it is coupled. Pressure junction 208 a may include a T-junction, coupling first fire display device 204*a* to common fuel line 202 such that first individual fuel line 214*a* may be perpendicular to common fuel line 202. In some embodiments, pressure junction 208*b* may also include a T-junction configured to coupled second fire display device 204*b* such that second fuel line 214*b* may be perpendicular to common fuel line 202 and individual fuel line 214*a* and individual fuel line 214*b* may extend from common fuel line 202 in opposite directions. In other embodiments, pressure junctions 208*c* may include a straight junction configured to couple third fire display device 204*c* to common fuel line 202 such that individual fuel line 214*c* extends in the same direction as common fuel line 202.

Each of fire display devices 204 may be communicatively coupled to a control module 218. Control module 218 may include an wireless receiver 220, a controller 222, and a battery 224. Wireless receiver 220 may be physically communicatively coupled (e.g., via a wire) to controller 222. Controller 222 may be physically and communicatively coupled to fire display device 204. Battery 224 may be electrically coupled to both wireless receiver 220 and controller 222, thus providing power to operate both. Control module 218 may be located external to or internal to a housing of fire display devices 204.

Controller 222 may also be physically and communicatively coupled to an input panel 223. Input panel 223 may form part of the housing of fire display devices 204 and may be used to select an audio or traditional mode as described above with respect to FIG. 1. Input panel 223 may be discussed further below with respect to FIGS. 2B and 5.

Wireless receiver 220 may be configured to receive wireless signals from a control hub 226. The hub 226 may be similar to, or the same as, the hub 110 described above with reference to FIG. 1. In one embodiment, wireless receiver 220 may also include a microphone and be capable of receiving verbal commands. Wireless receiver 220 may send corresponding signals to controller 222 in response to verbal commands.

Control hub 226 may be similar to hub 110 as described above with respect to FIG. 1. Control hub 226 may be an application executed at a mobile device such as a cellular telephone or laptop capable of sending and receiving wireless signals. Control hub 226 may wirelessly communicate a signal to wireless receiver 220 at each of fire display devices 204. In one embodiment, the signal may be sent via a Wi-Fi network. As one example, the signal may be an audio signal. Controller 222 may receive the audio signal from wireless receiver 220 and based on instructions stored in non-transitory memory, actuate components in response to the audio signal. Actuating components may include sending control signals to open or close electric valves or turn on electric ignitors. In another embodiment, control hub 226 may receive an audio signal and responsive to the audio signal and instructions stored in non-transitory memory, communicate commands to controller 222 via wireless receiver 220 to actuate components such as electric valves.

As another example, control hub 226 may wirelessly communicate instructions to controller 222 via wireless receiver 220 to change an operation mode of the fire display device (e.g., switch from audio mode to traditional mode) and/or to switch a fire display device on or off. controller 222.

Control hub 226 may wirelessly communicate instructions to one or more fire display devices 204 simultaneously. In this way, the actions of one or more fire display devices may be synchronized.

Figure 2B:
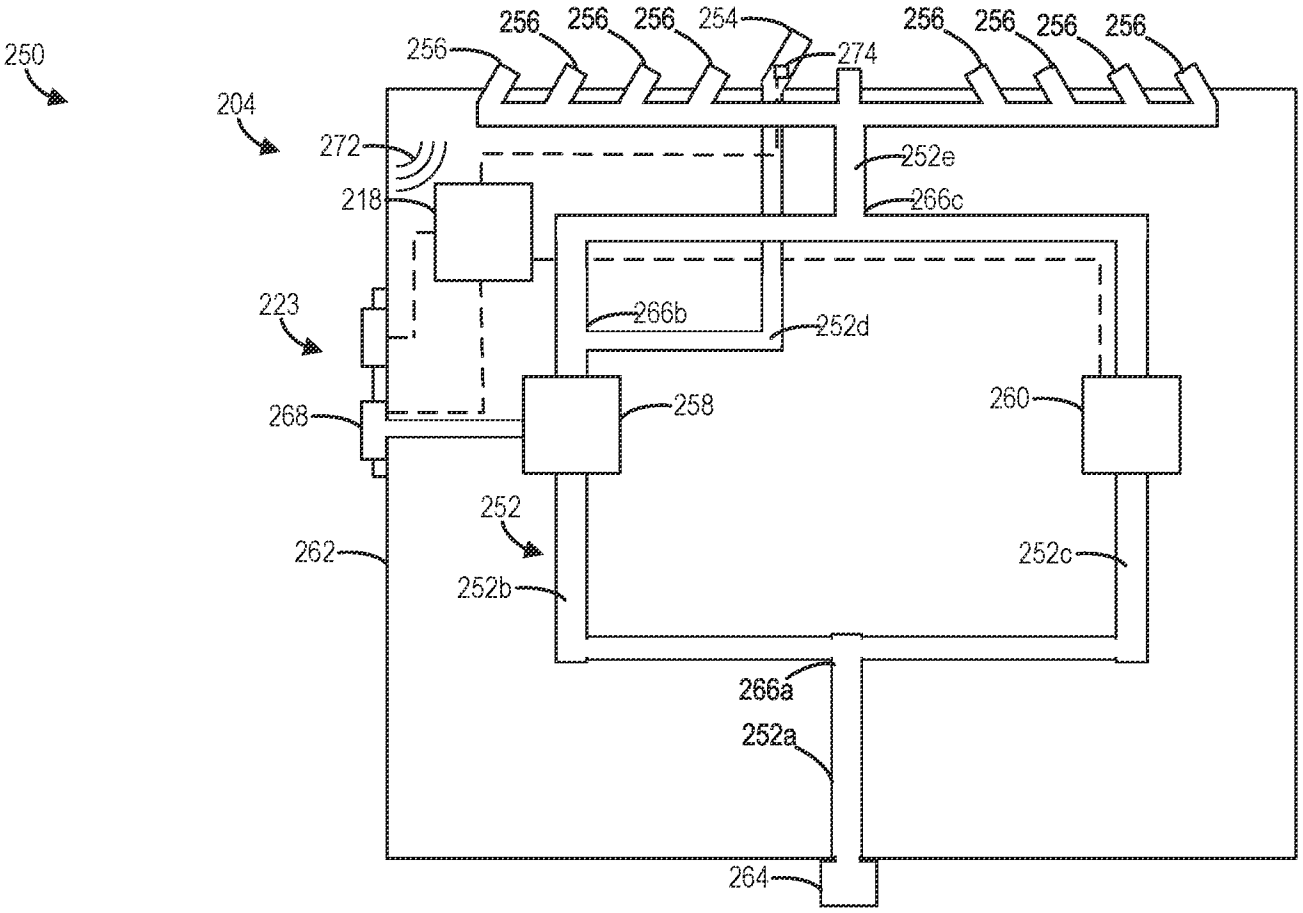
FIG. 2B shows an example of an ignition system for a fire display device of the fire pit system of FIG. 2A.

Looking briefly to FIG. 2B, FIG. 2B shows an example diagram 250 of the ignition configuration for one or more of the fire display devices 204. Fire display device 204 may include a fuel passage 252 fluidically coupled to a pilot light 254 and a plurality of fuel injectors 256 via a mechanical valve 258 and an electronic valve 260.

Fuel passage 252 may include an introductory portion 252*a* which may be fluidically coupled to a connector 264 positioned external to a housing 262 of fire display device 204. Connector 264 may be a quick connect coupled to individual fuel line 214 which is in turn coupled to common fuel line 202 as discussed above with respect to FIG. 2A. In one example, connector 264 may be position at a bottom side of the fire display device. Gaseous fuel traveling from introductory portion 252*a* towards pilot light 254 and fuel injectors 256 may reach a first junction 266*a* which may split fuel passage 252 into a mechanical portion 252*b* and an electric portion 252*c*. Mechanical portion 252*b* may further split at second junction 266*b* to include a pilot portion 252*d* fluidically coupled to pilot light 254. Mechanical portion 252*b* and electric portion 252*c* may rejoin at third junction 266*c* to become fuel injection portion 252*e* which is fluidically coupled to the plurality of fuel injectors 256.

Mechanical valve 258 may be configured to control a flow of gaseous fuel entering fuel injection portion 252*e* from mechanical portion 252*b*. In one example, mechanical valve 258 may be configured at mechanical portion 252*b* to also control the flow of gaseous fuel to pilot light 254. Mechanical valve 258 may be physically coupled to and controlled by user input device 268 positioned outside of housing 262. User input device 268 may be located at input panel 223 as discussed above with respect to FIG. 2A. For example, the user input device 268 may be a dial, where turning the dial a first direction may adjust the mechanical valve 258 to a more open position and turning the dial a second direction may adjust the mechanical valve 258 to a more closed position. Thus, via the user input device 268, a user is able to set a base amount of fuel allowed to flow through the mechanical valve 258 into fuel injection portion 252*e*.

Electronic valve 260 may be configured to control a flow of gaseous fuel from electric portion 252*c* into fuel injection portion 252*e*. Electronic valve 260 may be an actuated valve able to regulate gaseous flow over a range flow rates. For example, electronic valve 260 may be a butterfly valve or other adjustable electronic valve. Electronic valve 260 may be physically and communicatively coupled to control module 218. Control module 218 may include controller 222, battery 224, and wireless receiver 220 as above with respect to FIG. 2A. For example, control module 218 may receive a wireless signal 272 from a control hub (e.g., control hub 226) with instructions to control a position of electronic valve 260 to provide flame bursts synchronized with an audio input. In this way, mechanical valve 258 may control a base amount of fuel when fire display device 204 is operated in a traditional mode while electronic valve 260 may be actuated by control module 218 to provide additional fuel resulting in flame bursts coordinated by an audio signal when in audio mode.

In an alternate embodiment, mechanical valve 258 may be controlled electronically by physically and communicatively coupling to control module 218. In this way, mechanical valve 258 may be controlled by wireless signal 272 sent to control module 218 from the control hub as well as a signal generated by user input device 268.

Gaseous fuel reaching pilot light 254 may be ignited by a spark generated by ignitor 274. Ignitor 274 may be physically and communicatively coupled to control module 218 and may be actuated in response to a command from control module 218 and/or input panel 223. Control module 218 may receive a signal from user input device 268 and/or a wireless signal 272 commanding ignition of pilot light 254.

Once ignited, the pilot light may ignite the gaseous fuel flowing from plurality of fuel injectors 256 as controlled by both mechanical valve 258 and electronic valve 260. Additional details regarding plurality of fuel injectors 256 and pilot light 254 may be discussed in further detail below with respect to FIG. 4.

The fuel entering fire display device 204 as described above may be sourced from a common fuel line which may be intersected by a plurality of pressure junctions to deliver fuel to a plurality of fire display devices. Turning now to FIG. 3A-3B, examples of a pressure junction 302 for coupling a fire display device to a common fuel line 304 are shown. FIG. 3A shows view 300 of pressure junction 302 including a check valve 306 while FIG. 3B shows view 350 of pressure junction 302 showing both check valve 306 and a pressure regulator 352. Common fuel line 304 and pressure junction 302 may be similar to common fuel line 202 and pressure junctions 208 as discussed above with respect to FIG. 2A.

FIGS. 3A-3B show common fuel line 304 intersected by a T-junction 308. As discussed above, T-junction 308 may be a straight junction in some examples. T-junction 308 may be formed of a rigid non-porous material compatible with gaseous fuel. For example, T-junction 308 may be formed of a metal such as copper or stainless steel or T-junction 308 may be formed of a plastic such as polyvinyl chloride (PVC). T-junction 308 may include a first opening 310*a*, a second opening 310*b*, and a third opening 310*c*. First opening 310*a* and second opening 310*b* may be coupled to common fuel line 304 via gas tight couplers. For example, T-junction 308 may be coupled to common fuel line 304 via male and female thread pipe fittings. Third opening 310*c* of T-junction 308 may be likewise coupled to check valve 306. Check valve 306 may be similar to check valve 212 of FIG. 2A. Check valve 306 may be oriented so as to allow flow of gaseous fuel indicated by arrow 312. Check valve 306 may be a pressure type of check valve formed from a metal or plastic compatible with gaseous fuels.

FIG. 3B shows check valve 306 coupled to pressure regulator 352. Check valve 306 may be coupled to pressure regulator 352 via gas tight couplers such as male and female threaded pipe fittings. Pressure regulator 352 may receive gaseous fuel flowing from check valve 306 at a high pressure (e.g., 30 psi) and output gaseous fuel at a lower pressure (e.g., 5 psi or 0.5 psi) towards the fire display device (not shown). An outlet 354 of pressure regulator 352 may be coupled to a flexible fuel line 356 which may be similar to individual fuel lines 214 as shown in FIG. 2A. The fire display device may couple to the end of flexible fuel line 356 not coupled to pressure regulator 352 by a quick connect to deliver fuel the fire display device, eventually reaching a burner such as the burner shown in FIG. 4.

FIG. 4, shows a top-angled view 400 of burner 402, which may be incorporated into a surface of a fire display device such as fire pits 104 of FIG. 1. Burner 402 may include a pilot light 404, gaseous fuel injectors 408, and top plate 414. Pilot light 404 and gaseous fuel injectors 408 may be similar to pilot light 254 and fuel injectors 256 of FIG. 2B. Burner 402 may be fluidically coupled to a pressurized tank of gaseous fuel as described above with respect to FIGS. 2A-2B.

Gaseous fuel injectors 408 may be positioned and angled such that gaseous fuel is injected to a focal point 416 which may be configured at a horizontal center of burner 402 and a vertical height 420 above the edge of an outer housing of the fire display device. Gaseous fuel injectors 408 may be fluidically coupled to gaseous fuel and to each other via a fuel injector line 410 (such as fuel injection portion 252*e* of FIG. 2A), and arrayed in various configurations which allow the gaseous fuel to be injected to focal point 416. In one example, fuel injector line 410 may form an inner circle 411 and an outer circle 412 connected by spokes 418. Spokes 418 may extend from center post 422 to inner circle 411. Post 422 includes a hole 423 formed therein for additional gaseous fuel flow directed towards the focal point 416. Further, spokes 418 may fluidically couple to outer circle 412 to inner circle 411.

Pilot light 404 may include an electric ignitor (e.g., ignitor 274) which may be actuated in response to a command from a controller or user input (such as controller 222 or input panel 223 of FIG. 2A). When ignited, pilot light 404 may be configured to provide a flame which extends above gaseous fuel injectors 408 and crosses a plane parallel to top plate 414, intersecting the focused streams of gaseous fuel at focal point 416. In this way, a burst effect may be readily visible, for example when fuel flowing to gaseous fuel injectors 408 is increased in response to an audio input as described above with respect to FIG. 2B. In one embodiment, pilot light 404 may be located between inner circle 411 and outer circle 412.

Top plate 414 may be configured to cover a top portion of the fire display device. Fuel injector line 410, gaseous fuel injectors 408, and pilot light 404 may all extend through and above top plate 414. Top plate 414 may include a plurality of openings 424 which may improve air flow.

Figure 5:
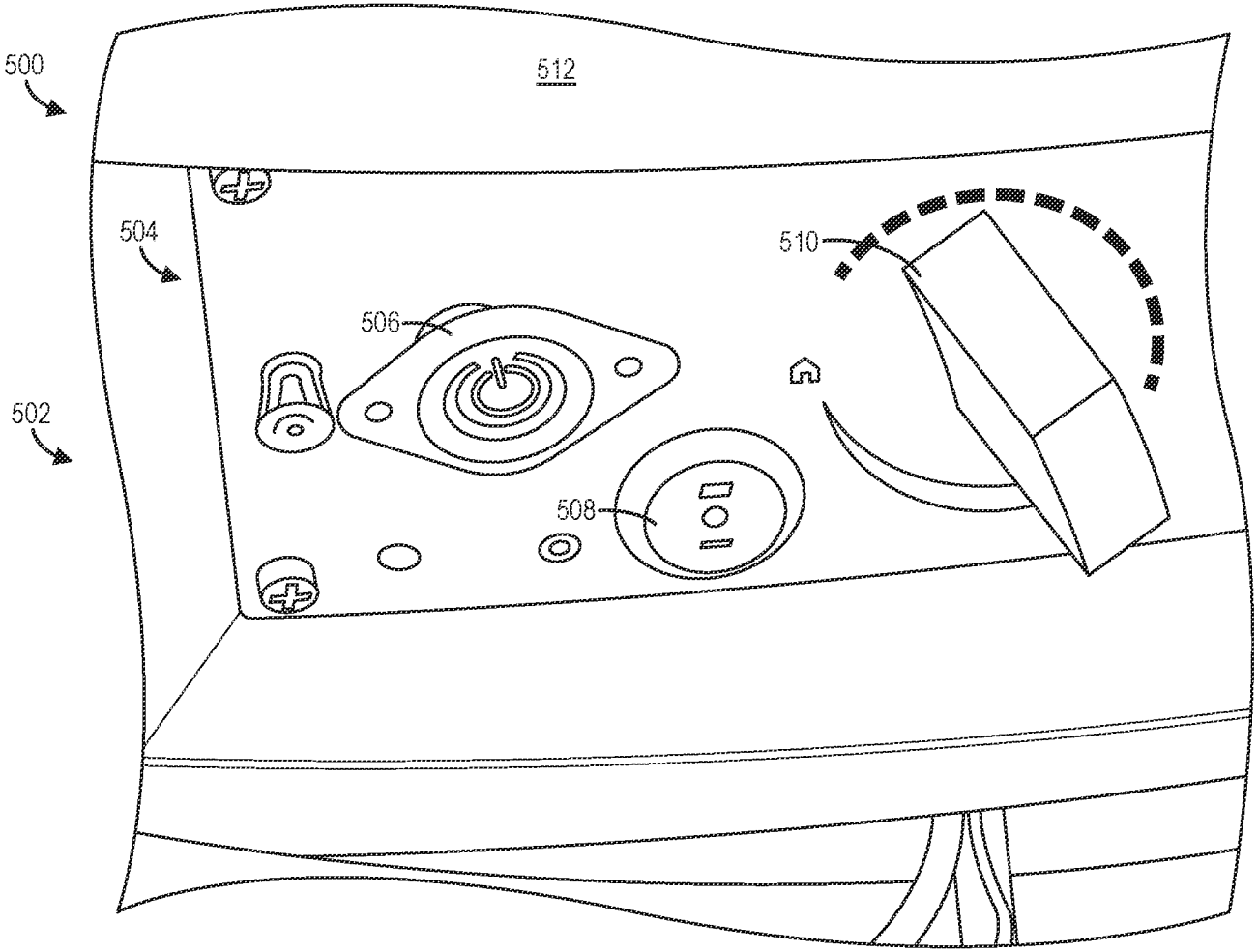
FIG. 5 shows a control panel for a fire pit of a fire pit system.
Figure 6A:
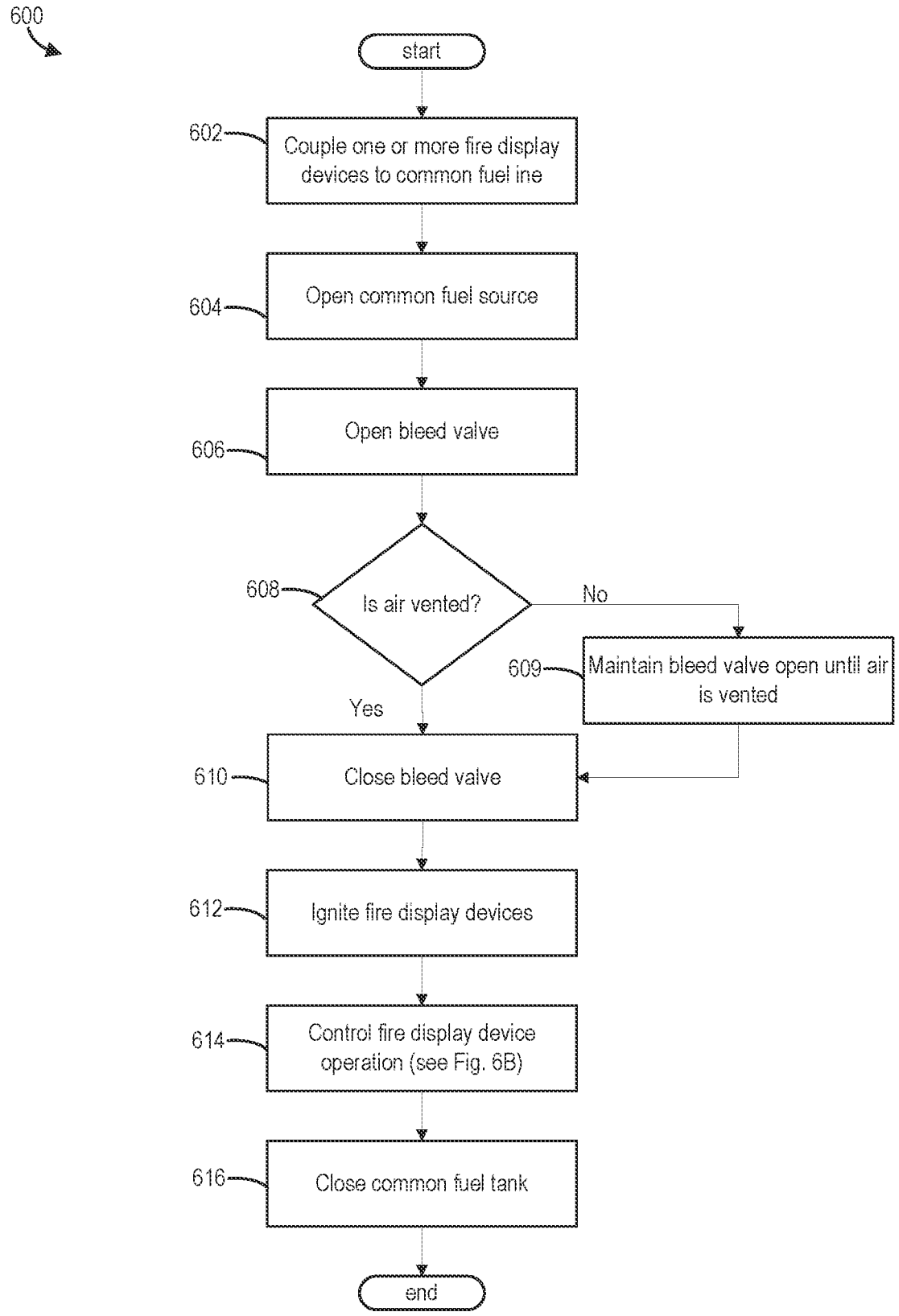
FIG. 6A and FIG. 6B show flow charts illustrating a method for operating a fire pit system.

Turning now to FIG. 5, an example 500 is shown of a side view 502 of a section of a fire display device such as fire pit 104 of FIG. 1. Side view 502 may include user input device 504. User input device 504 may be similar to user input panel 223 as discussed above with respect to FIG. 2A. User input device 504 may be coupled to an outer housing 512 of the fire display device to be readily accessed by a user. In one example, user input device 504 may be recessed into housing 512 so as to avoid accidental user inputs.

User input device 504 may include an ignite button 506, mode button 508 and dial 510. Ignite button 506 may be coupled to a controller such as controller 222 FIGS. 2A and 2B respectively. Pressing ignite button 506 may send a signal to the controller to actuate an ignitor in a pilot light, as discussed above with respect to FIGS. 2B and 4.

Dial 510 may be physically coupled to a mechanical valve (such as mechanical valve 258 as discussed above with respect to FIG. 2B). Positions of dial 510 may control an amount of fuel passing to a fuel injection line as described above with respect FIG. 2B. In an alternate embodiment where mechanical valve 258 may be controlled electronically, dial 510 may be physically and communicatively coupled to the controller. In such an example, a user input at dial 510 may instruct the controller to open or close the mechanical valve.

Mode button 508 may send a signal to the controller instructing a mode of fire display device operation. Mode button 508 may be any type of toggle switch allowing a user to toggle between three positions corresponding to three modes. The three modes may be flame off, non-boosted mode, and audio input mode. Non-boosted mode and audio input mode may correspond to different operational modes as discussed above with respect to FIG. 1. Further, the operational modes may be discussed in more detail below with respect to FIG. 6A-B Turning to FIG. 6A, a flow chart illustrating a method 600 for operating a fire display system is shown. The fire display system may be similar to, or the same as, the fire display systems described above with respect to FIGS. 1 and 2A. The fire display system includes one or more fire display devices. The one or more fire display devices may be similar to, or the same as, the fire display device 204 described above with reference to FIGS. 2A-2B, in some examples. Instructions for carrying out method 600 and the rest of the methods included herein may be executed by a controller based on instructions stored on a memory of the controller and in conjunction with signals received from sensors of the fire display system, such as the sensors described above with reference to FIG. 1. The controller may employ actuators of the system to adjust system operation, according to the methods described below.

At 602, method 600 includes coupling one or more fire display devices to a common fuel line. The one or more fire display devices may be fire pits or torches as described above with respect to FIG. 1. The common fuel line may be a pressurized fuel line configured to deliver gaseous fuel from a common fuel source, such as fuel source 203 as described above with respect to FIG. 2A. Coupling the one or more fire display devices may include attaching the fire display device to a pressure junction via an individual fuel line using a quick connect as described above with respect to FIG. 2A.

The method continues from 602 to 604 where the method includes opening the common fuel source. The common fuel source may be coupled to the common fuel line via a pressure regulator such as first pressure regulator 206 as described above with respect to FIG. 2A. As such, opening the common fuel source may result in the common fuel line being filled with gas at a pressure set by a first pressure regulator configured to control gas flow out of the common fuel source and into the common fuel line. In one example, the pressure set by the first pressure regulator may be 30 psi.

At 606, method 600 includes opening a bleed valve such as bleed valve 217 described above with respect to FIG. 2A. Opening the bleed valve may be done manually by an operator of the fire display system. Opening the bleed valve may allow air trapped in the common fuel line to escape as it is being pushed out by gaseous fuel entering the common fuel line from the common fuel source. Alternatively, the bleed valve may be automatically opened via a mechanical actuator responsive to a user input to the control hub indicating an initial coupling of the common fuel source to the common fuel line.

At 608, the method includes determining whether air has been vented from the common fuel line. Determining if the air has been vented from the common fuel line may be done manually by an operator and may include identifying a smell of propane gas coming from the bleed valve, indicating that there is no air remaining in the common fuel line. Alternatively, a user may determine a threshold amount of time for the bleed valve to remain open, after which the air is considered to be vented from the common fuel line. In one or more examples, the bleed valve may be automatically opened and held opened for the threshold amount of time to purge air from the common fuel line.

If it is determined that air has not been vented from the common fuel line at 608, the method continues to 609 and the bleed valve is maintained in an open position until air is vented as determined by smell or elapsed time as describe above with respect to step 608. If it is determined that air has been vented from the common fuel line at 608 or at 609, the method continues from 608 to 610 where the method includes closing the bleed valve. Closing the bleed valve may include manually adjusting a position of the bleed valve to stop the flow of gaseous fuel from leaving through the bleed valve via a user input device of the bleed valve or automatically closing the bleed valve.

At 612, method 600 includes lighting the fire display devices. After the bleed line is closed at 610, the fire display devices may be supplied with gaseous fuel from the common fuel line at a pressure determined by a second pressure regulator coupled to the fire display device as described above with respect to FIG. 2A. Igniting the fire display device may include sending a signal to a controller communicatively coupled to an ignitor configured within a pilot light. In some examples, the signal may be sent to the controller via a user input panel as described above with respect to FIG. 5. Additionally or alternatively, the signal may be sent from a control hub to the control module as described above with respect to FIG. 2A.

Method 600 continues to 614 where operation of the fire display device is controlled as described in further detail in FIG. 6B below. After operation of the fire display device, method 600 proceeds to 616 at which point the common fuel source is closed. Closing the common fuel source may include closing a valve on the common fuel tank so that gaseous fuel is no longer delivered to the common fuel line.

Figure 6B:
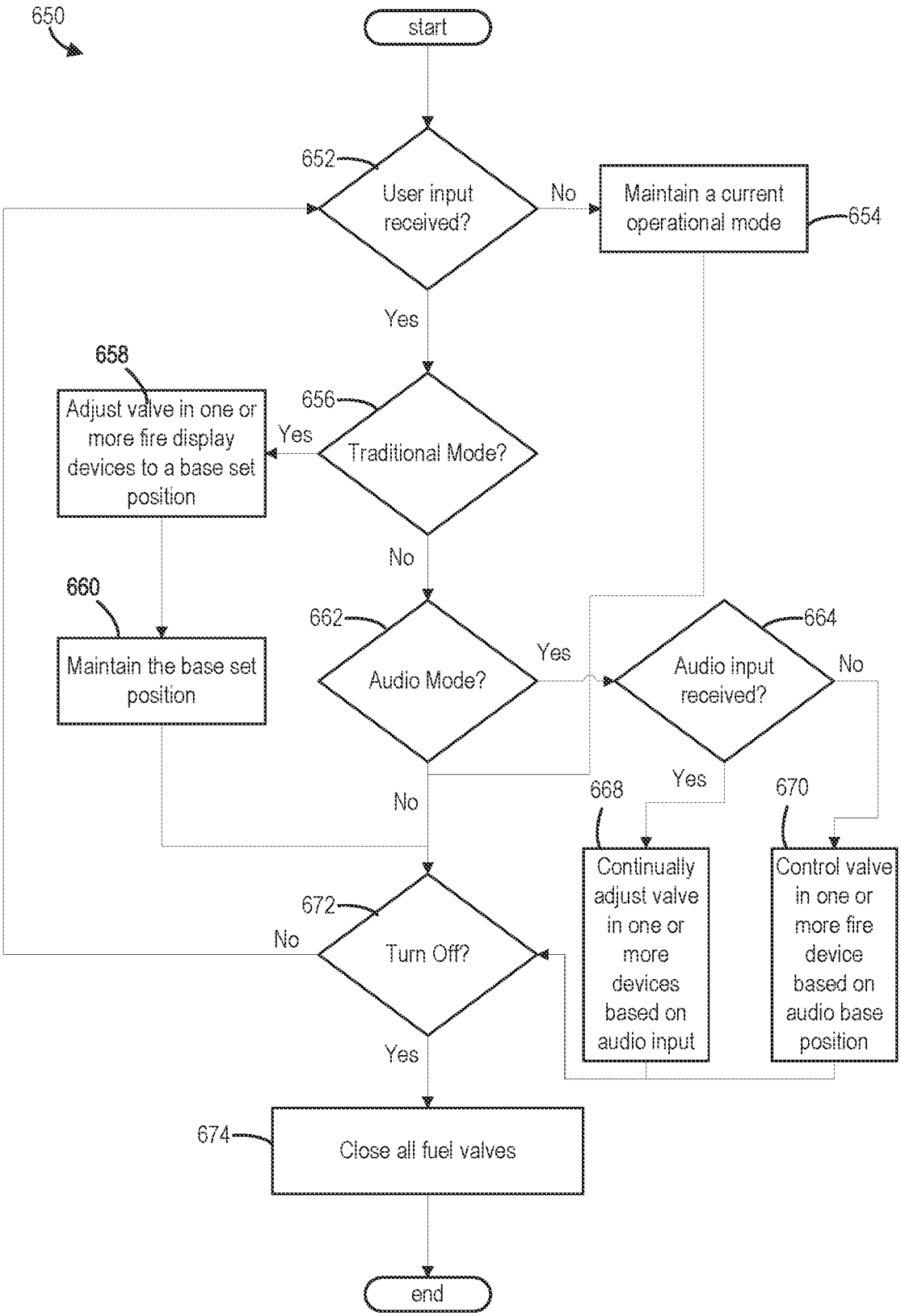

Turning now to FIG. 6B, a flow chart of a method 650 for controlling a fire display device coupled to a common fuel line as part of method 600 is shown. Method 650 may include executable instructions included in the non-transitory memory of a control hub and/or control module. A control module may include a wireless receiver, controller, and a battery; and is capable of receiving wireless signals from the control hub as described above with respect to FIG. 2A.

At 652, method 650 determines if there is a user input. A user input may be received via a user input device as described above with respect to FIG. 2B and FIG. 5, or via a command to a control module from a control hub as described above with respect to FIG. 2A. If there is not a user input, method 650 proceeds to 654 where the method maintains the current operational mode. If a user input is received, method 650 proceeds to 656 where it is determined if the user input is for traditional mode.

If the user input is for traditional mode, a valve is adjusted in the one or more fire display devices to a base set position at 658. The adjusted valve may be a mechanical valve such as mechanical valve 258 as described above with respect to FIG. 2B. In one embodiment, the adjustment may be made via a physically coupled user input such as a dial. Additionally or alternatively the mechanical valve may be capable of being controlled by user input to the control module via the control hub and/or user input panel. Further a base set position of an electronic valve such as electronic valve 260 described above with respect to FIG. 2B may be set in response to user input for traditional mode. A base position of electronic valve 260 may be set my instructions from the control module. If adjusted by a control hub, the base set position of one or more fire display devices may be set simultaneously. At 660, method 650 maintains the base set position before continuing to step 672.

If the user input is not for traditional mode, method 650 determines if the user input is for audio mode. If the user input is for audio mode, method 650 proceeds to 664 where it is determined if an audio input is received. If an audio input is not received, a control valve in one or more fire display devices is set to an audio base position at 670. The control valve setting the audio base position may be the electric valve as described above with respect to FIG. 2B. The audio base position may be set via the control hub. If an audio input is received, the control valve may be continually adjusted in one or more devices based on audio input. The audio input may be received at the one or more fire display devices via a wireless signal received by a wireless receiver from the control hub. Instructions for continual adjustment of the control valve may be given by the controller receiving the audio input from the wireless receiver. In this way the flame height in response to an audio input may be adjust at a plurality of fire display devices simultaneously. After step 668 or 670, method 650 proceeds to 672. Method 650 also proceeds to 672 from 662 if the user input is not for audio mode.

At 672, method 650 determines if the user input is to turn the fire display device off. If the user input is not to turn the fire display device off, then method 650 returns to 652. If the user input is to turn the fire display device off, method 650 continues to 674 and closes all fuel valves. All fuel valves may include both the mechanical valve and the electric valve. If both the mechanical valve and electrical valve are communicatively coupled to the controller, then all fuel valves may be closed at one or more fire display devices by a command from the control module. The command may be wirelessly issued to the control module by the control hub. If the mechanical valve is not communicatively coupled to the controller than closing all fuel valves may include physically closing the mechanical valve at the user input device as well as a command from the control hub.

In this way a fire display including multiple fire display devices may be simplified and an entertainment value may be increased. One or more fire display devices may share a single common fuel tank via coupling to a common fuel line. The one or more fire display devices may be coupled via a quick connect allowing for convenient, tool free coupling and decoupling of the one or more fire display devices to the common fuel line. Additionally, the one or more fire display devices may include a pilot light configured to intersect with a focal point of gaseous fuel injectors above a top surface of the fire display device, providing an easily visible and pleasing fire effect. Further, the one or more fire display devices may be coupled to a control module configured to receive wireless signals from a control hub. The signals from the control hub may be simultaneously received by a plurality of fire display devices allowing for synchronous control.

The disclosure also provides support for a fire display system, comprising: a fuel source comprising gaseous fuel, a common fuel line coupled to the fuel source via a first pressure regulator providing the gaseous fuel to the common fuel line at a first pressure, and a first fire display device fluidically coupled to the common fuel line, wherein the first fire display device is coupled to the common fuel line via a second pressure regulator arranged downstream of the first pressure regulator and providing the gaseous fuel to the first fire display device at a second pressure that is lower than the first pressure. In a first example of the system, a second fire display device is fluidically coupled to the common fuel line via a third pressure regulator arranged downstream of the first pressure regulator and providing the gaseous fuel to the second fire display device at a third pressure that is lower than the first pressure. In a second example of the system, optionally including the first example, the third pressure is equal to the second pressure. In a third example of the system, optionally including one or both of the first and second examples, the third pressure is a different pressure, lower than the second pressure. In a fourth example of the system, optionally including one or more or each of the first through third examples, the system further comprises: a bleed valve coupled to the common fuel line that is configured to vent air out of the common fuel line. In a fifth example of the system, optionally including one or more or each of the first through fourth examples, the bleed valve is positioned at an opposite end of the common fuel line as the fuel source. The disclosure also provides support for a fire display system, comprising: a fuel source comprising gaseous fuel, a common fuel line coupled to the fuel source via a first pressure regulator, wherein the first pressure regulator is configured to provide the gaseous fuel to the common fuel line at a first pressure, and a plurality of fire display devices each fluidically coupled to the common fuel line via respective pressure regulators, the respective pressure regulators configured to flow the gaseous fuel from the common fuel line to the plurality of fire display devices at pressures less than the first pressure. In a first example of the system, the system further comprises: a bleed valve coupled to the common fuel line, wherein the bleed valve is downstream of the plurality of fire display devices. In a second example of the system, optionally including the first example, the bleed valve is configured to release air out of the common fuel line. In a third example of the system, optionally including one or both of the first and second examples, the plurality of fire display devices are each further fluidically coupled to the common fuel line via respective check valves. In a fourth example of the system, optionally including one or more or each of the first through third examples, the respective pressure regulators include a second pressure regulator, and wherein the second pressure regulator is positioned between the common fuel line and a first fire display device of the plurality of fire display devices. In a fifth example of the system, optionally including one or more or each of the first through fourth examples, a fuel line extends between the second pressure regulator and the first fire display device. In a sixth example of the system, optionally including one or more or each of the first through fifth examples, each of the plurality of fire display devices comprises: a burner, an electrically actuatable gas valve configured to adjust an amount of gaseous fuel flowed to the burner for ignition, a wireless receiver, and a controller, wherein the comprises instructions stored in non-transitory memory of the controller that are executable to: adjust a position of the electrically actuatable gas valve responsive to a request received via the wireless receiver. In a seventh example of the system, optionally including one or more or each of the first through sixth examples, the request received via the wireless receiver is from a hub of the fire display system. The disclosure also provides support for a method for operating a multi flame display, comprising: providing gaseous fuel to a common fuel line at a first pressure via a first common fuel line pressure regulator, and flowing the gaseous fuel to a plurality of flame display devices, wherein the plurality of flame display devices are fluidically coupled to the common fuel line downstream via respective pressure regulators, wherein the respective pressure regulators are positioned downstream the first common fuel line pressure regulator and provide the gaseous fuel to the plurality of flame display devices from the common fuel line to the plurality of flame display devices at lower pressures than the first pressure. In a first example of the method, the method further comprises: after providing the gaseous fuel to the common fuel line at the first pressure and prior to flowing the gaseous fuel to the plurality of flame display devices, venting air trapped in the common fuel line via a bleed valve. In a second example of the method, optionally including the first example, venting the air trapped in the common fuel line includes opening the bleed valve to release the air out of the common fuel line. In a third example of the method, optionally including one or both of the first and second examples, the method further comprises: igniting the gaseous fuel flowed to the plurality of flame display devices responsive to commands received at the plurality of flame display devices from a hub that are coordinated to an audio input. In a fourth example of the method, optionally including one or more or each of the first through third examples, the commands are received wirelessly from the hub, and wherein igniting the gaseous fuel flowed to the plurality of flame display devices incudes adjusting a position of an electric valve included in each of the plurality of flame display devices. In a fifth example of the method, optionally including one or more or each of the first through fourth examples, the commands received at a first flame display device differs from the commands received at a second flame display device of the plurality of flame display devices.

FIGS. 1 and 3-5 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. Moreover, it is noted that reference to upstream and downstream may be made based on a direction of fuel flow from the fuel source.

Note that the example control and estimation routines included herein can be used with various system configurations. The control methods and routines disclosed herein may be stored as executable instructions in non-transitory memory and may be carried out by the control system including the controller in combination with the various sensors, actuators, and other hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations, and/or functions may be repeatedly performed depending on the particular strategy being used. Further, the described actions, operations, and/or functions may graphically represent code to be programmed into non-transitory memory of the computer readable storage medium in the control system, where the described actions are carried out by executing the instructions in a system including the various hardware components in combination with the hub controller and/or the fire device controller.

It will be appreciated that the configurations and routines disclosed herein are exemplary in nature, and that these specific embodiments are not to be considered in a limiting sense, because numerous variations are possible. Moreover, unless explicitly stated to the contrary, the terms "first," "second," "third," and the like are not intended to denote any order, position, quantity, or importance, but rather are used merely as labels to distinguish one element from another. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A fire display system, comprising:

a fuel source comprising gaseous fuel;

a common fuel line coupled to the fuel source via a first pressure regulator providing the gaseous fuel to the common fuel line at a first pressure; and a first fire display device fluidically coupled to the common fuel line, wherein the first fire display device is coupled to the common fuel line via a second pressure regulator arranged downstream of the first pressure regulator and providing the gaseous fuel to the first fire display device at a second pressure that is lower than the first pressure, wherein a second fire display device is fluidically coupled to the common fuel line via a third pressure regulator arranged downstream of the first pressure regulator and providing the gaseous fuel to the second fire display device at a third pressure that is lower than the first pressure.

2. The fire display system of claim 1, wherein the third pressure is equal to the second pressure.

3. The fire display system of claim 1, wherein the third pressure is a different pressure, lower than the second pressure.

4. A fire display system, comprising:

a fuel source comprising gaseous fuel;

a common fuel line coupled to the fuel source via a first pressure regulator providing the gaseous fuel to the common fuel line at a first pressure;

a first fire display device fluidically coupled to the common fuel line, wherein the first fire display device is coupled to the common fuel line via a second pressure regulator arranged downstream of the first pressure regulator and providing the gaseous fuel to the first fire display device at a second pressure that is lower than the first pressure; and a bleed valve coupled to the common fuel line that is configured to vent air out of the common fuel line.

5. The fire display system of claim 4, wherein the bleed valve is positioned at an opposite end of the common fuel line as the fuel source.

6. A fire display system, comprising:

a fuel source comprising gaseous fuel;

a common fuel line coupled to the fuel source via a first pressure regulator, wherein the first pressure regulator is configured to provide the gaseous fuel to the common fuel line at a first pressure; and a plurality of fire display devices each fluidically coupled to the common fuel line via respective pressure regulators, the respective pressure regulators configured to flow the gaseous fuel from the common fuel line to the plurality of fire display devices at pressures less than the first pressure, wherein the respective pressure regulators include a second pressure regulator, and wherein the second pressure regulator is positioned between the common fuel line and a first fire display device of the plurality of fire display devices.

7. The fire display system of claim 6, further comprising a bleed valve coupled to the common fuel line, wherein the bleed valve is downstream of the plurality of fire display devices.

8. The fire display system of claim 7, wherein the bleed valve is configured to release air out of the common fuel line.

9. The fire display system of claim 6, wherein the plurality of fire display devices are each further fluidically coupled to the common fuel line via respective check valves.

10. The fire display system of claim 6, wherein a fuel line extends between the second pressure regulator and the first fire display device.

11. The fire display system of claim 6, wherein each of the plurality of fire display devices comprises:

a burner;

an electrically actuatable gas valve configured to adjust an amount of gaseous fuel flowed to the burner for ignition;

a wireless receiver; and a controller, wherein the comprises instructions stored in non-transitory memory of the controller that are executable to:

adjust a position of the electrically actuatable gas valve responsive to a request received via the wireless receiver.

12. The fire display system of claim 11, wherein the request received via the wireless receiver is from a hub of the fire display system.

13. A method for operating a multi flame display, comprising:

providing gaseous fuel to a common fuel line at a first pressure via a first common fuel line pressure regulator; and flowing the gaseous fuel to a plurality of flame display devices, wherein the plurality of flame display devices are fluidically coupled to the common fuel line downstream via respective pressure regulators, wherein the respective pressure regulators are positioned downstream the first common fuel line pressure regulator and provide the gaseous fuel to the plurality of flame display devices from the common fuel line to the plurality of flame display devices at lower pressures than the first pressure, the method further comprising igniting the gaseous fuel flowed to the plurality of flame display devices responsive to commands received at the plurality of flame display devices from a hub that are coordinated to an audio input.

14. The method of claim 13, further comprising, after providing the gaseous fuel to the common fuel line at the first pressure and prior to flowing the gaseous fuel to the plurality of flame display devices, venting air trapped in the common fuel line via a bleed valve.

15. The method of claim 14, wherein venting the air trapped in the common fuel line includes opening the bleed valve to release the air out of the common fuel line.

16. The method of claim 13, wherein the commands are received wirelessly from the hub, and wherein igniting the gaseous fuel flowed to the plurality of flame display devices incudes adjusting a position of an electric valve included in each of the plurality of flame display devices.

17. The method of claim 16, wherein the commands received at a first flame display device differs from the commands received at a second flame display device of the plurality of flame display devices.

* * * * *